United States Patent [19]

Bruce et al.

[11] 4,214,431

[45] * Jul. 29, 1980

[54] METHOD AND APPARATUS FOR RIGGING MARINE VESSELS

[76] Inventors: Wayne M. Bruce, 29 Little River Rd., South Dartmouth, Mass. 02748; Walter J. Bruce, 109 Oakland St., New Bedford, Mass. 01730

[ * ] Notice: The portion of the term of this patent subsequent to Mar. 6, 1996, has been disclaimed.

[21] Appl. No.: 958,450

[22] Filed: Nov. 7, 1978

Related U.S. Application Data

[63] Continuation of Ser. No. 920,125, Jun. 28, 1978, Pat. No. 4,142,353.

[51] Int. Cl.[3] ..... B65H 69/06

[52] U.S. Cl. ..... 57/22; 57/2.3; 57/3.5; 242/86.5 R

[58] Field of Search ..... 57/22, 23, 3.5, 2.3, 57/2.5, 202; 242/25 R, 86.5 R, 86.51, 86.7

[56] References Cited

U.S. PATENT DOCUMENTS

| | | | |
|---|---|---|---|
| 458,672 | 9/1891 | Borrman | 57/22 |
| 1,421,151 | 6/1922 | Bennett | 57/22 |
| 1,521,906 | 1/1925 | Rohr | 57/22 |
| 1,530,602 | 3/1925 | Kelly | 57/22 |
| 1,895,828 | 1/1933 | Van Inwagen, Jr. | 57/22 X |
| 2,019,519 | 11/1935 | Wood | 57/22 X |
| 2,019,520 | 11/1935 | Wood | 57/22 |
| 2,216,189 | 10/1940 | Ennis | 57/3.5 |
| 3,009,307 | 11/1961 | Hansen | 57/3.5 |
| 3,675,407 | 7/1972 | LaRue | 57/22 |

*Primary Examiner*—John Petrakes

*Attorney, Agent, or Firm*—Mason, Fenwick & Lawrence

[57] ABSTRACT

A marine rigging apparatus for splicing new wire cable of the type having twisted wire strands to a portion of worn wire cable taken from a rotatable drum on a fishing vessel docked or moored adjacent a dock, said apparatus including a motor vehicle having a base mounted thereon, at least one bearing mounted on the base, at least one drum rotatably supported by the bearing, a hydraulic motor operatively connected to the drum for rotating the drum to wind the worn cable onto the drum, a rigger's vise mounted on the base for clamping portions of cables to be spliced with the cables being restrained against rotation about the axes of the cables, and a twister device mounted on the base for rotating one of the cables in a direction opposed its natural twist to relieve the tension in the strands of the cable at a desired location on the cable to permit an efficient and quick splicing of the other cable to the twisted cable.

13 Claims, 17 Drawing Figures

FIG. 13
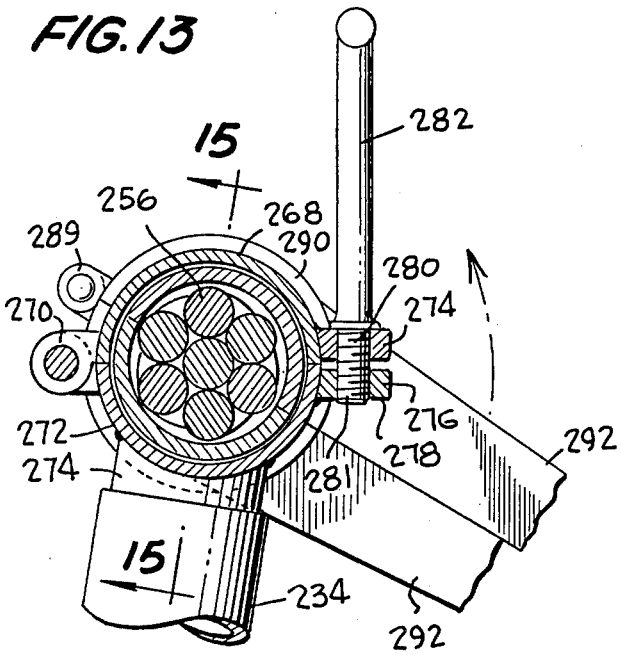
FIG. 14
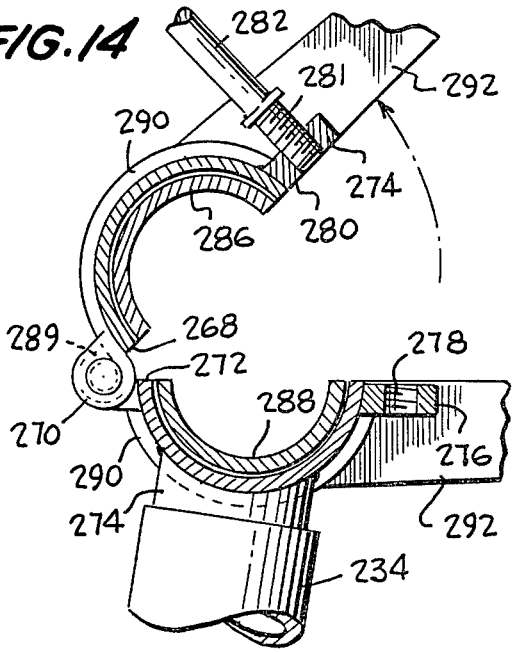
FIG. 16
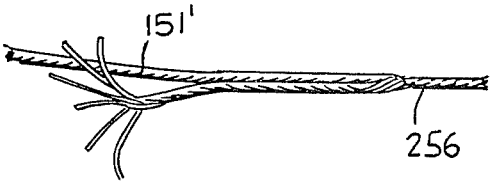
FIG. 17
FIG. 15
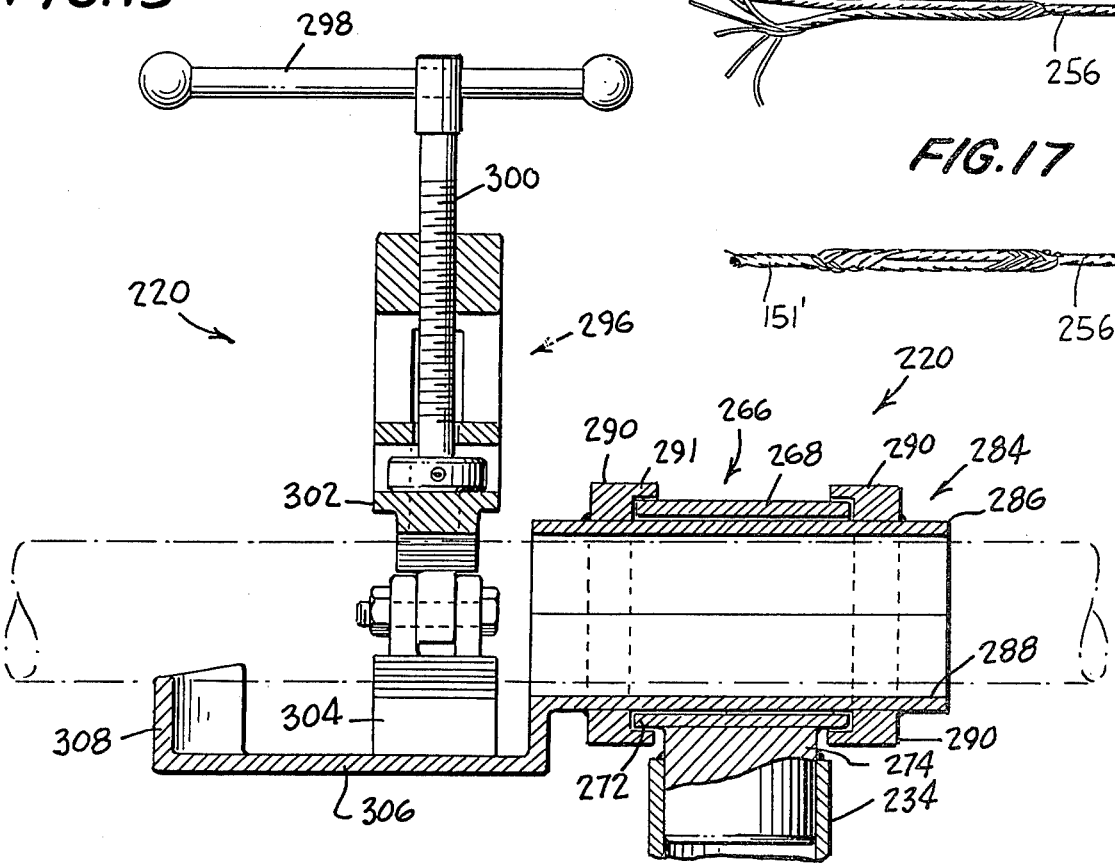

METHOD AND APPARATUS FOR RIGGING MARINE VESSELS

This is a continuation of application Ser. No. 920,125, filed June 28, 1978, now U.S. Pat. No. 4,142,353.

This invention is in the field of fishing vessel service equipment and is specifically directed to a marine rigging truck for removing, installing and/or splicing steel trawling cables for fishing vessels.

In the United States, the greatest portion of the New England Fishing Fleet includes vessels known as stern trawlers. In the fishing vessels known as stern trawlers, two lines of steel cable, carried on two drums or reels containing approximately 1800 feet of cable, are extended rearwardly from the vessel approximately 420 to 1200 feet, depending on the depth of water in which the vessels are fishing. Nets, attached to the ends of the cables, are dragged along the bottom of the ocean when the vessel is fishing.

After approximately a year of use which might include 25 fishing trips, the cable becomes rusted and/or damaged and will therefore require replacement. As portions of the cable become damaged, the skipper of the vessel will remove 50 to 100 feet of the damaged cable and continue to use the remaining cable. When the old cable becomes too short to carry the nets to the desired depth, new cable will be required. Rather than discard the remaining old cable, it becomes necessary to splice new cable to the old cable with a minimum of 600 feet at a time replaced to limit the number of splices in the cable.

Prior to the present invention, the removal of these old cables was manually performed by several men who dragged the cable from the drums on the vessel by hand and stretched them out along the full length of the dock to which the vessel was tied. It was necessary to remove the entire length of old cable which could be anywhere from 600 to 1200 feet in length and to splice the new cable to the last few feet of old cable since the new cable must be reeled onto the cable drums on the vessel first. The new cable was then laid out on the dock so that the unspliced end of the new cable could be attached to the vessel's drums which leaves the older cable on the outer portion to be used first.

This previously-known method of adding new cable to the old cable on fishing vessels was very dependent on the weather and on having sufficient space on the dock adjacent the boat to permit stretching out the cable. Both cables from the vessel had to be stretched out side-by-side in order to match the fathom markings which are pieces of nylon string inserted through the cable every 10 fathoms to permit the skipper of the vessel to determine how many feet of cable he had extended during his fishing operations. If automobiles or trucks were parked on the dock or if the boat were not in the proper position, the operation could not be completed. Prior to the present invention, a splicer required a dock with little or no traffic and good weather to permit replacement of the cable on the fishing vessel. With this previously-known method, the total time required was 6 to 8 hours and required at least six men to perform.

Therefore, it is the object of the present invention to provide a new and improved method and apparatus for rigging marine vessels.

Another object of the present invention is to provide apparatus and means for splicing new cable to cables on the cable drums of fishing vessels.

A further object of the present invention is to provide a method and apparatus for quickly and efficiently replacing the cable on a fishing vessel which is not dependent upon good weather or having large areas of dock space.

A still further object of the present invention is to provide a method and apparatus for replacing wire cable on a vessel which requires very few workers and very little time.

Another object of the present invention is to provide an apparatus which is capable of removing and storing the wire cable from fishing vessels and does not require that the vessels be docked but may be moored away from the dock.

A further object of the present invention is to provide a device which relieves the tension in a wire cable and simplifies the splicing operation.

A better understanding of the manner in which the preferred embodiments of the invention achieves the objects of the invention will be enabled when the following written description is read in conjunction with the appended drawings in which:

FIG. 13 is an enlarged cross-sectional view of the twister device taken along line 13—13 in FIG. 12;

FIG. 14 illustrates the twister device of FIG. 13 in an open position;

FIG. 15 is a fragmentary cross-sectional view taken along line 15—15 in FIG. 13;

FIG. 16 illustrates a cable with a single splice; and,

FIG. 17 illustrates a cable with a double splice.

Figure 1:
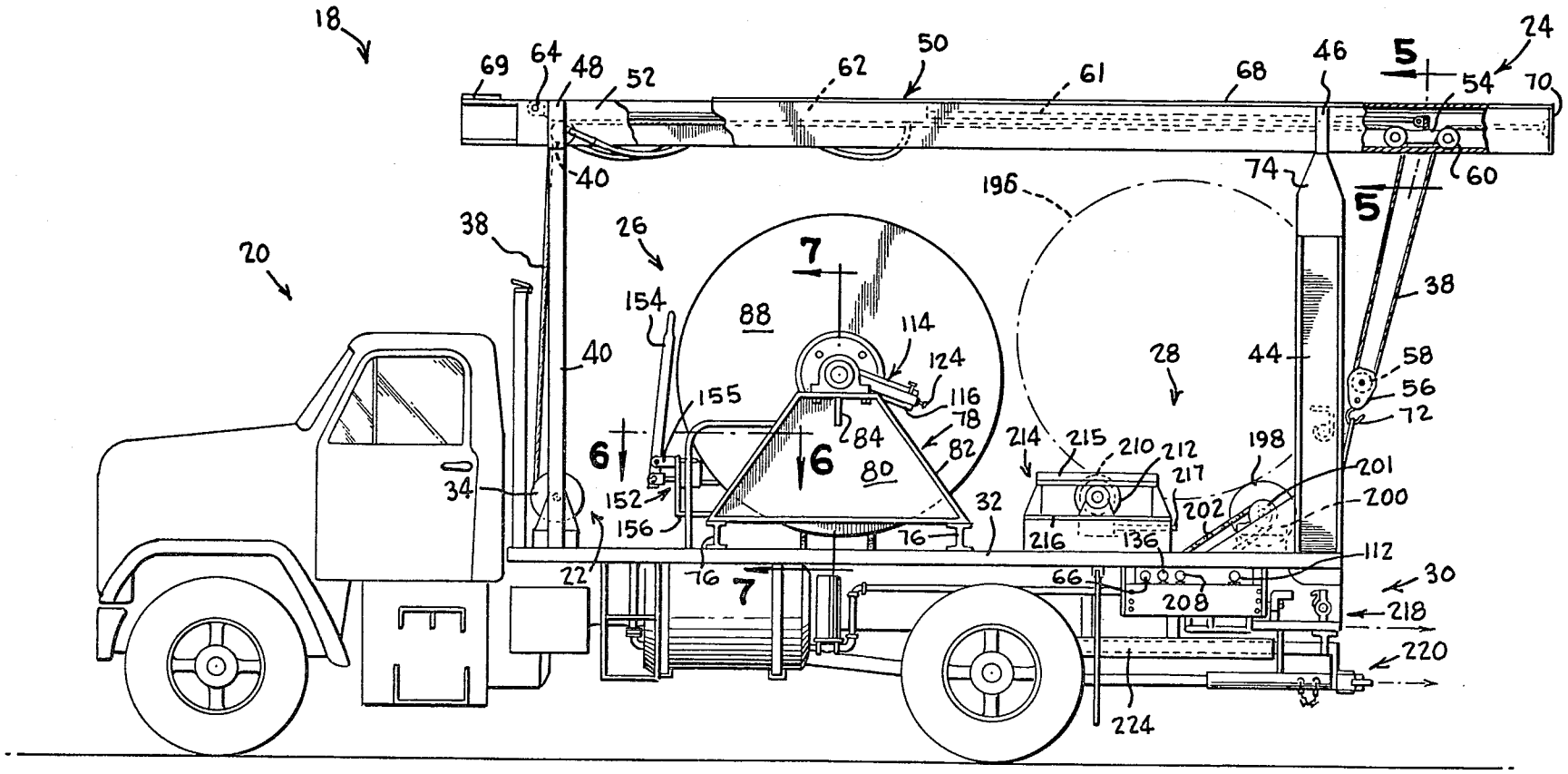
FIG. 1 is a side elevational view of the preferred embodiment of the present invention.

Attention is initially invited to the various Figures of the drawings illustrating the preferred embodiment of the invention, indicated by reference numeral 18 which includes a flat bed truck 20 having mounted thereon a cargo winch 22, a cargo boom 24, a rigging winch 26, a coiling mechanism 28, and a splicing mechanism 30.

The truck 20 includes a conventional deck or base 32 on which the various elements are mounted as shown in FIGS. 1–4. A power supply, which is not shown in the Figures, for operation of the various complements includes an air-controlled power take-off unit from the vehicle engine such as a 671 Detroit Diesel Engine. The power take-off drives a conventional double hydraulic pump supplying from 12 to 29 gallons per minute of hydraulic fluid at a pressure of 1,000 psi.

Figures 2, 5:
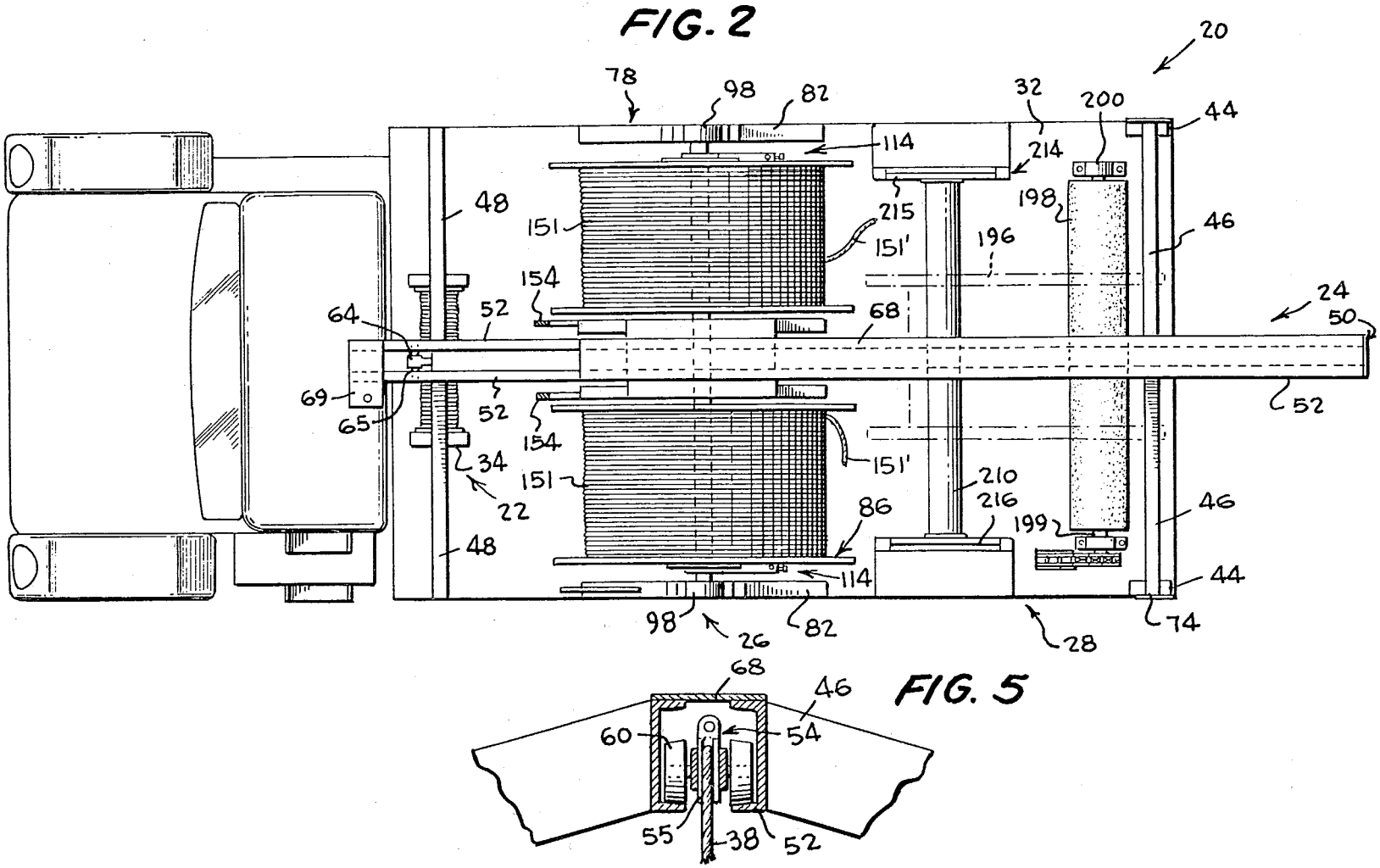
FIG. 2 is a top view of the preferred embodiment.
FIG. 5 is an enlarged fragmentary cross-sectional view taken along line 5—5 in FIG. 1.

The cargo winch 22 is mounted by bolts extending through the deck 32 to the main chassis of the truck 20 and, as can best be seen in FIGS. 1 and 2, includes a drum 34 which is driven by a conventional hydraulic motor and gear reduction unit which are not disclosed in detail. The hydraulic motor on the cargo winch 22 is supplied with pressurized hydraulic fluid from the power supply of the truck 20 when a control valve 36 mounted below the left-rear corner of the deck 32 of the truck is manually controlled by the operator. Control valve 36 permits the operator to extend or retract a wire cable 38 which is reeled on the drum 34 and extends vertically upwardly from the drum to a pulley 40 on the cargo boom 24 as indicated in FIG. 1. The cargo winch 22, in combination with the cargo boom 24 to be discussed hereafter, is used to load and unload spools of cable from delivery trucks and to place spools of cable on jacks or turntables for removal of the cable from the spools.

Figure 3:
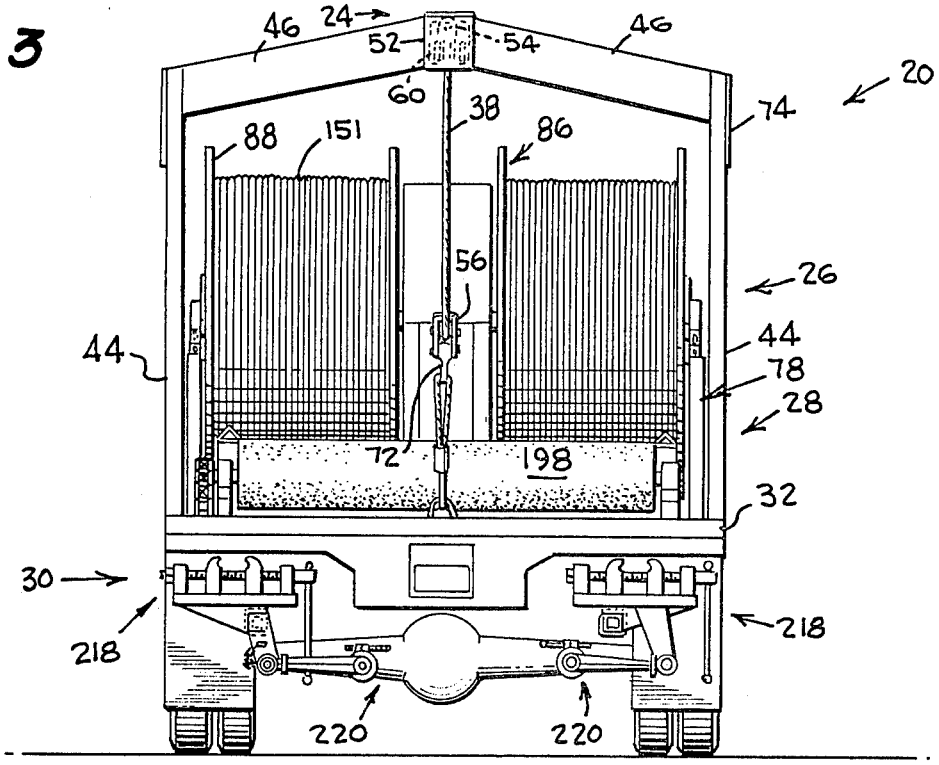
FIG. 3 is a rear elevational view of the preferred embodiment.

Support for the cargo boom 24 is provided by a pair of forward legs 40 and a pair of rear legs 44 welded at their lower ends to the truck deck 32. Overhead members 46 and 48, as best shown in FIG. 3, extend from the upper ends of the rear legs 44 and the forward legs 40 to a centrally-positioned boom member 50. The boom member 50 is formed by two lengths of H/D channel-stock which are welded to the upper members 46 and 48 with the channels facing inwardly and spaced apart to provide a track with a downwardly open slot therethrough for a four-wheeled trolley 54 to travel therein.

The boom cable 38 from the cargo winch 22 extends rearwardly from the pulley 40 to a pulley 55 on the trolley and downwardly to a block 56. The cable 38 then extends around a pulley 58 on the block 56 and back up to the trolley 54 where it is fixed to the trolley. Wheels 60 on the trolley 54 travel along the boom members 52 with the cable 38 extending downwardly through the slot between the boom members.

The trolley 54 is positioned at the desired location by a piston 61 of a hydraulic cylinder 62 as indicated in FIG. 1. A rear clevis 64 on the hydraulic cylinder 62 is fixed to the boom members 52 by a pin 65 as shown in FIG. 2. Movement of piston 61 of the hydraulic cylinder 62 is achieved with a control valve 66 mounted adjacent control valve 36 on the left rear corner of the truck. The control valve 66 directs pressurized hydraulic fluid to and from hydraulic cylinder 62 from the truck power supply to move the trolley 54 to a desired position.

Figure 4:
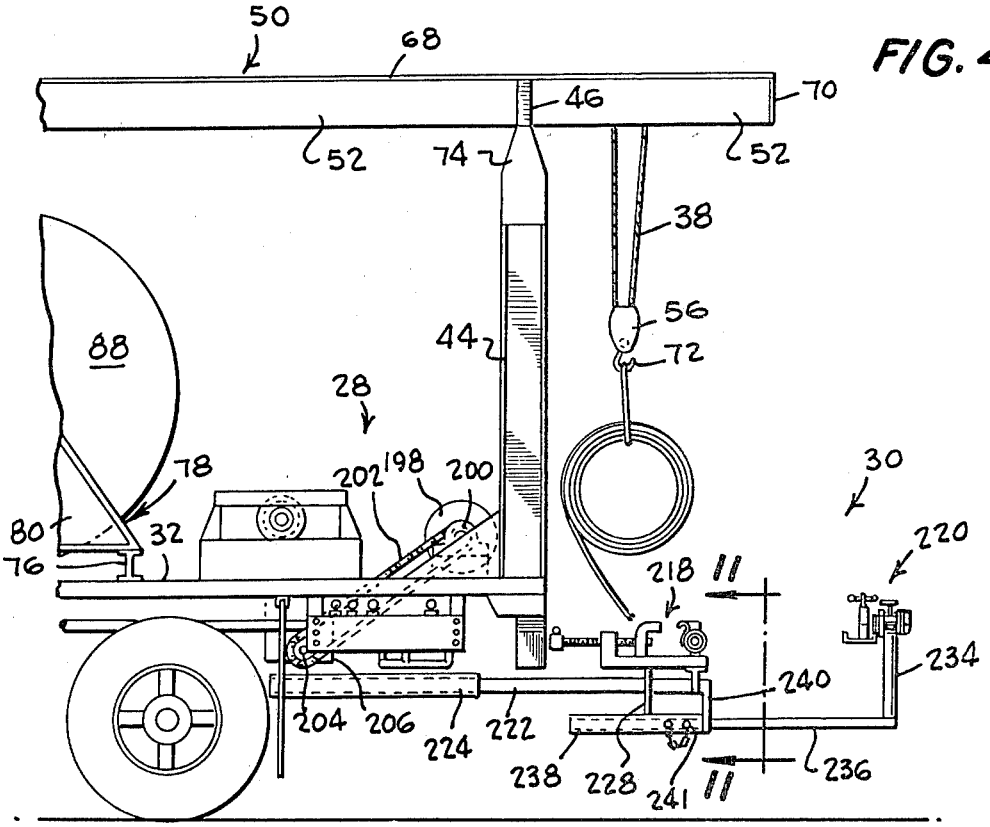
FIG. 4 is a fragmentary side elevational view of the preferred embodiment with the splicing mechanism extended.

A cover plate 68, end cover plate 69, and end plate 70 may be welded to the boom members 52 to prevent rain, snow, dust, dirt or the like from interfering with the operation of the trolley 54 and the hydraulic cylinder 62. A cargo hook 72 is attached to the block 56 to permit hoisting of drums, coils or the like as indicated in FIG. 4. Appropriate reinforcing plates 74 may be added to the upper portion of the legs 44 shown in FIGS. 1–4 to provide for adequate strength in the structure.

A base for the rigging winch 26 is provided by two H-beams 76, as best shown in FIGS. 1 and 4, which extend across the width of the deck 32 and are welded thereto. Positioned upright near the outer ends of the base beams 76 are stands 78 formed of a trapizoidal-shaped steel plate 80 having a narrow steel plate 82 welded to the outer edge of the plate 80 to provide rigidity to the plate and permit bolting of the stand 78 to the base beams 76. A triangular gusset plate 84 is welded to the stand plate 80 and the edge strip 82 at the upper center of the stand plate as shown in FIGS. 1 and 7 to increase the strength and rigidity of the stand to carry the loads imposed thereon during the rigging operation.

Figure 7:
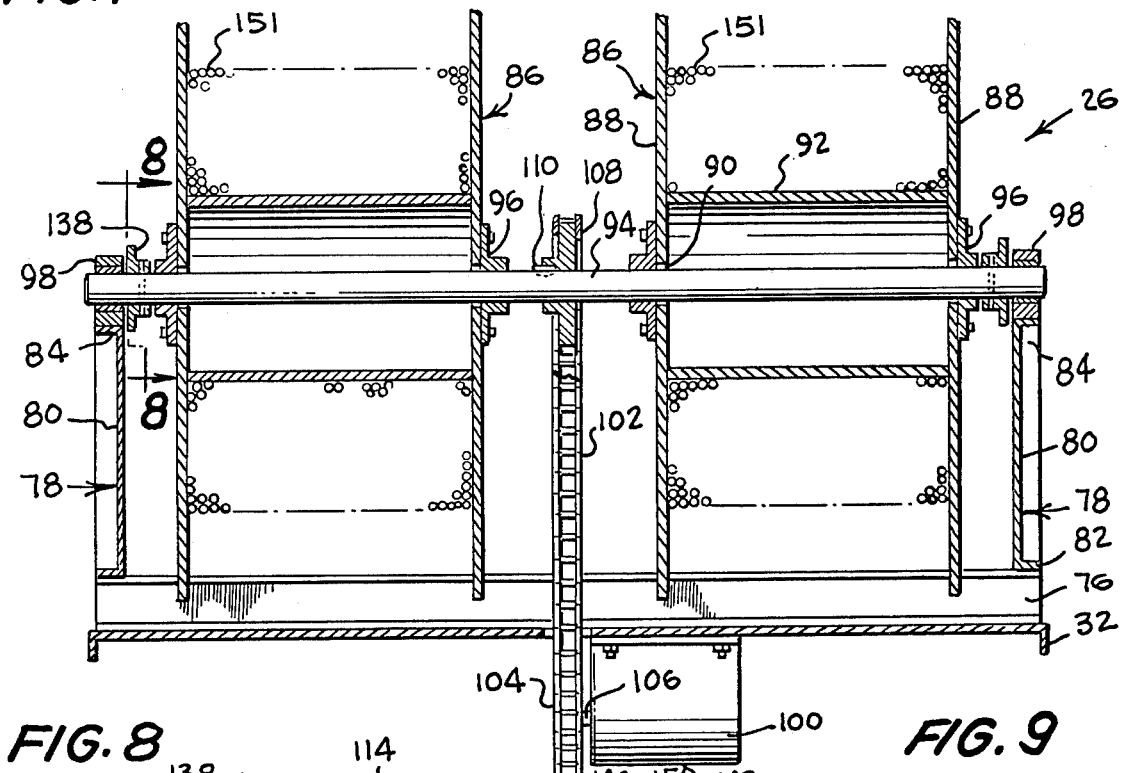
FIG. 7 is an enlarged fragmentary cross-sectional view of the preferred embodiment taken along line 7—7 in FIG. 1.

Two drums 86 are mounted between the stands 78, as best shown in FIG. 7. The drums 86 are formed by two circular steel plates 88 having shaft openings 90 at the centers thereof with hollow cylindrical hubs 92 welded at its opposite ends to the end-plates 88. The cable drums 86, as shown in FIG. 7, are rotatably supported on a drive shaft 94 by flange bearings 96 mounted on each end-plate 88.

The drive shaft 94 extends beyond both drums 86 and is rotatably retained in support bearings 98 mounted on the top of each stand 78 above the gusset plates 84. The flange bearings 96 on the drums 86 permit the drums to rotate freely with respect to the drive shaft 94 as discussed hereafter.

A second pair of stands 78 and support bearings 98 may be mounted between the drums 86 if additional strength and rigidity in the system is desired. If two stands 78 are utilized for each drum, it would be desirable to provide two independent drive shafts in order to avoid misalignment of the support bearings 98.

The drive shaft 94 is driven by a conventional hydraulic motor 100 mounted on a lower surface of the deck 32 as shown in FIG. 7. Power from the hydraulic motor 100 is transmitted to the drive shaft 94 by a chain belt 102 which engages a drive sprocket 104 mounted on a drive shaft 106 of the hydraulic motor 100 and engages a driven sprocket 108 fixed to the drive shaft 94 by a key 110. Control for the hydraulic motor 100 is provided by a control valve 112 mounted on the left rear corner of the truck deck as shown in FIG. 1, which supplies pressurized hydraulic fluid from the truch power supply as desired by the operator of the truck.

Figure 8:
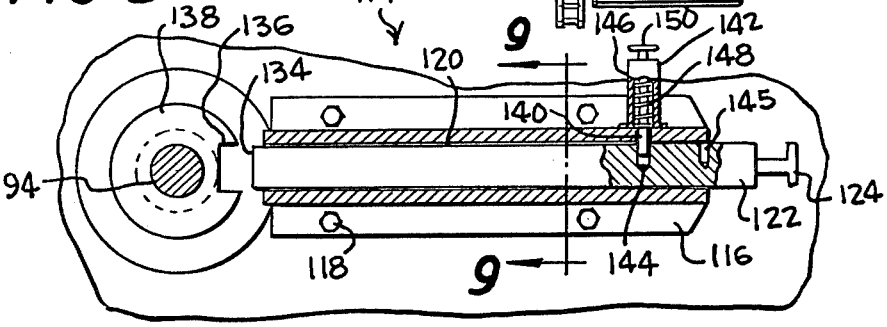
FIG. 8 is an enlarged fragmentary cross-sectional view taken along line 8—8 in FIG. 7.
Figure 9:
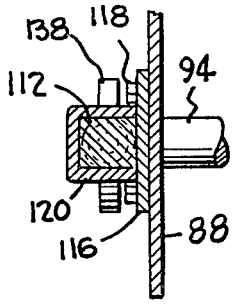
FIG. 9 is a fragmentary cross-sectional view taken along line 9—9 in FIG. 8.

Power from the drive shaft 94 is transmitted to the drums 86 through a dog-clutch 114 on each drum, as best shown in FIGS. 1, 8 and 9. The dog-clutch 114 includes a clutch housing 116 bolted to the drum plate 88 by bolts 118, with the housing oriented in a radial direction relative to the drive shaft 94. A rectangular guideway 120, as shown in FIGS. 8 and 9, extends through the housing 116 to receive a close fitting plunger member 122 having a handle 124 at the end thereof to be grasped by the operator. The guide member 122 slides freely toward and away from the drive shaft 94, as shown in FIG. 8, by manual operation. The plunging member 122 extends through the guideway 120, to form a latching portion 134 which is positioned to engage a slot 136 in a latching hub 138 fixed to the drive shaft 94.

The plunger member 122 is retained in the retracted position and in the drice position by a retaining pin 140 mounted in a pin housing 142 attached to the plunger housing 116. The retaining pin 140 projects transversely into a bore 144 in the side of the plunger member 122 when the plunger member 122 is in the retracted position and a bore 145 when in the engaged position. The retaining pin 140 is biased into the plunger member 122 by a biasing spring 146 positioned between the plunger housing 142 and a flange 148 formed on the pin 140. The pin 140 is retracted by a handle 150 fixed to the pin 140 as desired by the operator. When the latching position 134 engages the slot 136, the drum 86 will rotate with the drive shaft 94.

Figure 6:
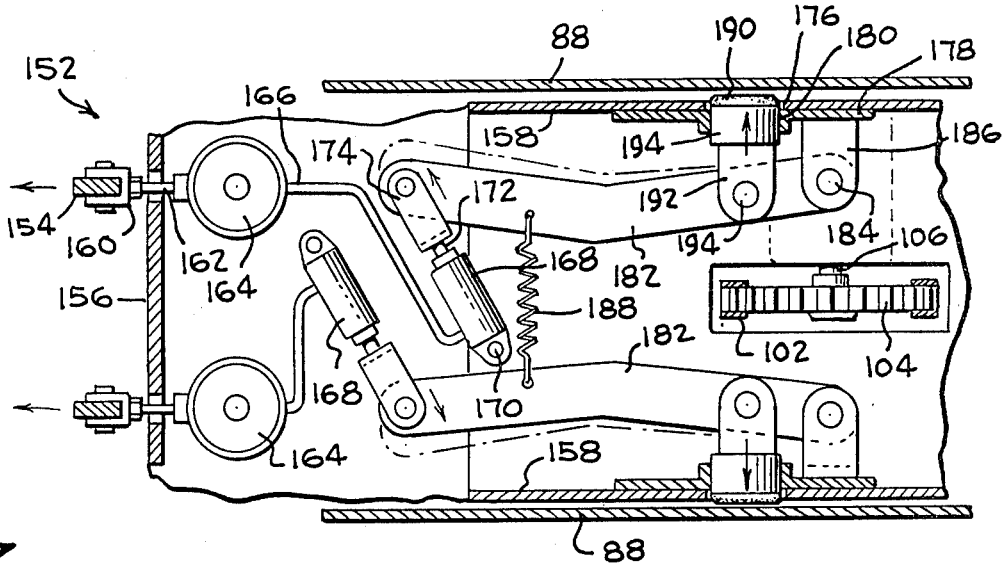
FIG. 6 is an enlarged fragmentary cross-sectional view of the braking system taken along line 6—6 in FIG. 1.

When the dog-clutch 114 is disengaged and the drums 86 are free to rotate, two braking mechanisms 152 are provided to prevent the cable 151 from being tangled on the drum 86 if the cable is not being taken up by the drums on the fishing vessel as rapidly as the drum 86 is rotating. The braking mechanisms 152 are located between the drums on the forward side of the rigging winch 26 as indicated in FIG. 1 and include manually-operable levers 154 pivotally supported on pivot supports 155 of a mounting bracket 156 fixed to the base beam 76 as suggested in FIG. 1. The mounting bracket 156 includes a pair of upright brake support walls 158, as shown in FIG. 6, which extends upwardly and parallel to the drum plates 88.

A lower end of the lever 154 has pivotally mounted thereon a clevis 160 attached to an actuation rod 162 of a master cylinder unit 164. Pressurized hydraulic fluid is supplied by the master cylinder unit 164 through tubing 166 to a hydraulic actuator 168 pivotally mounted on pin 170 to a support bracket 156. The piston of actuator 168 drives a connecting rod 172 connected to a clevis 174. Mounted on the bracket 158 is a brake mounting flange 178 having a central opening 180 aligned with an opening 176 through the support bracket 158. A brake lever 182 is pivotally supported by a pin 184 on a pivot plate 186 fixed to the flange 178 as shown in FIG. 6.

The free end of the brake lever 182 is pivotally mounted to the clevis 174 and the pair of brake levers 182 are biased toward each other by a biasing spring 188 attached to each of the levers. A disc brake pad 190 is biased toward the drum plate 88 through the openings 176 and 180 by a drive link 192 pivotally supported on pin 194 on brake lever 182 at its free end and having a brake disc support plate 194 sized to slide through openings 176 and 180. Brake lever 182 biases the disc pad 190 against the drum plate 88 when actuator 168 is supplied with hydraulic fluid from the master cylinder 164 as the manually-operable lever 154 is rotated forward by the operator.

The coiling mechanism 28 is positioned immediately to the rear of the rigging winch 26 at the back of the truck deck 32. This mechanism coils cable onto a drum 196 as indicated in FIGS. 1 and 2. The coiling mechanism 28 includes a powered drive cylinder 198 rotatably supported on a drive shaft 199 extending through bearings 200. A drive sprocket 201 is attached to the end of the shaft 199 and engages with a chain belt 202 which is driven by a sprocket 204 mounted on a conventional hydraulic drive motor 206 attached to a lower surface of the truck deck 32 as shown in FIG. 4. The hydraulic motor 206 is operated in either direction by means of a control valve 208 mounted on the left rear corner of the truck as shown in FIG. 1 to supply pressurized hydraulic fluid from the truck power supply system to the hydraulic motor. The outer surface of the drive cylinder 198 is covered with a hard rubber material to provide sufficient friction to drive the spool of cable 196 in the desired direction.

An undriven support shaft 210 is rotatably supported in bearings 212 which are slidably mounted in a housing 214 to move toward and away from the drive cylinder 198. The bearings 212 move fore and aft on guideways 215 and 216 as desired by means of a lead screw 217 which can be rotated to position the support shaft 210 in a desired position relative to the drive cylinder 198 which allows the mechanism to adapt to many different sized spools.

Figure 11:
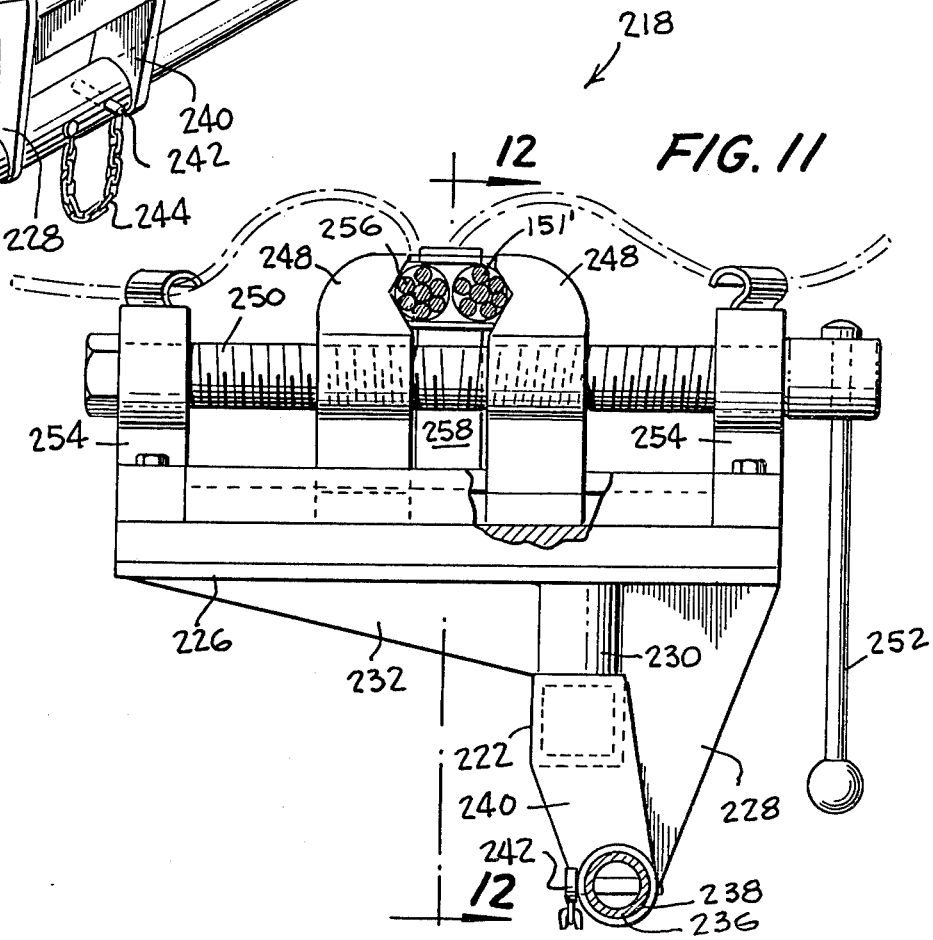
FIG. 11 is a side elevational view of the rigger's vise illustrated in FIG. 10.

Mounted below and at the rear of the truck deck 32 are the two splicing mechanisms 30 which include a conventional three-jaw rigger's vise 218 and a twister mechanism 220. The rigger's vise 218 is mounted on a square shaft 222 which telescopically fits closely within a larger square tube 224 bolted to the truck chassis as shown in FIG. 4. The rigger's vise 218 is attached to the square shaft 222 by a mounting plate 226 having downwardly projecting support members 228 and 230 which are welded to the shaft 222. A reinforcing gusset plate 232 extends between the support member 230 and the rigger's vise base plate 226, as shown in FIG. 11 to provide support for the rigger's vise 218.

Figure 10:
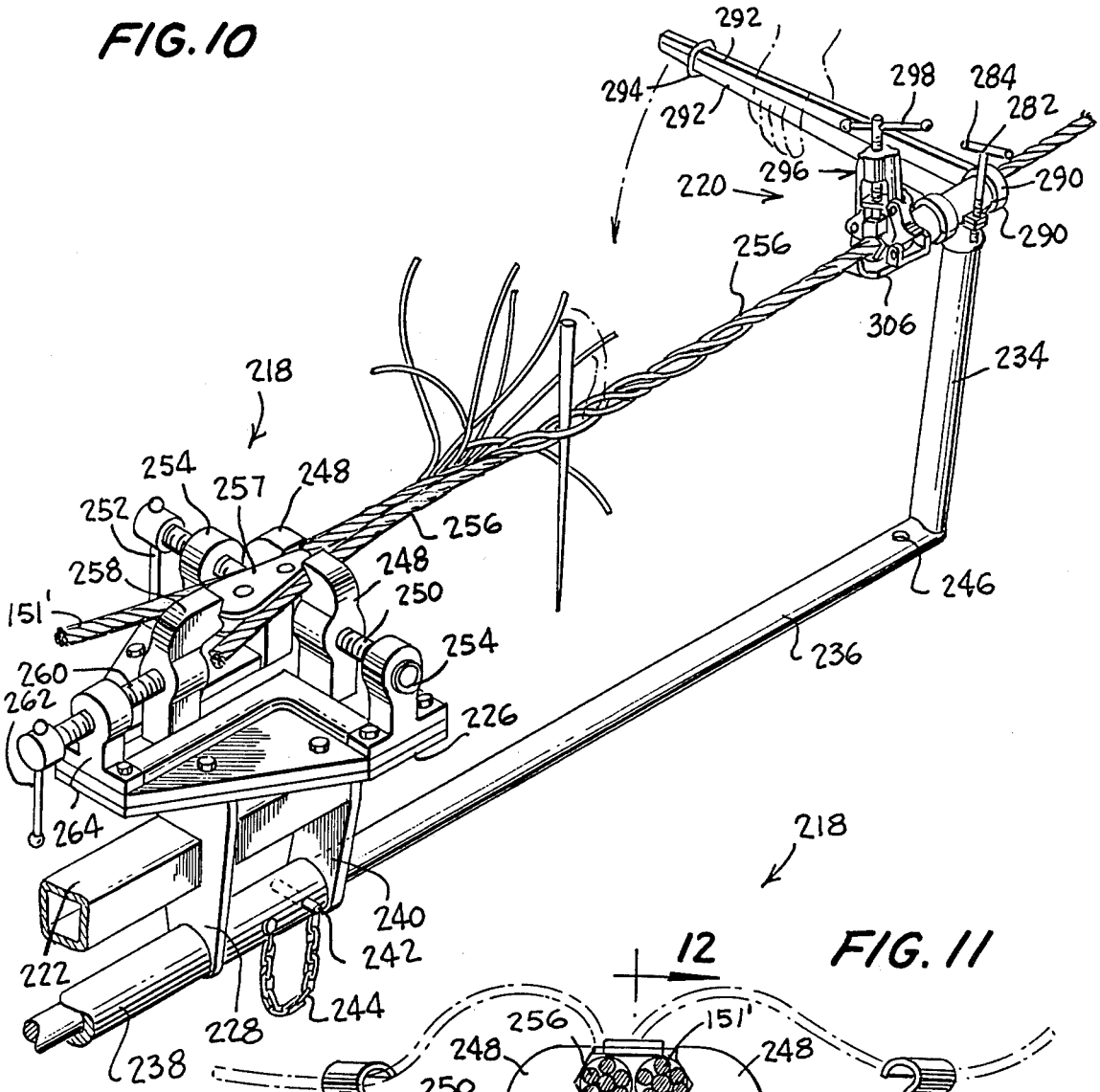
FIG. 10 is an enlarged perspective view of the splicing mechanism with the hand of an operator illustrated rotating the twister device.
Figure 12:
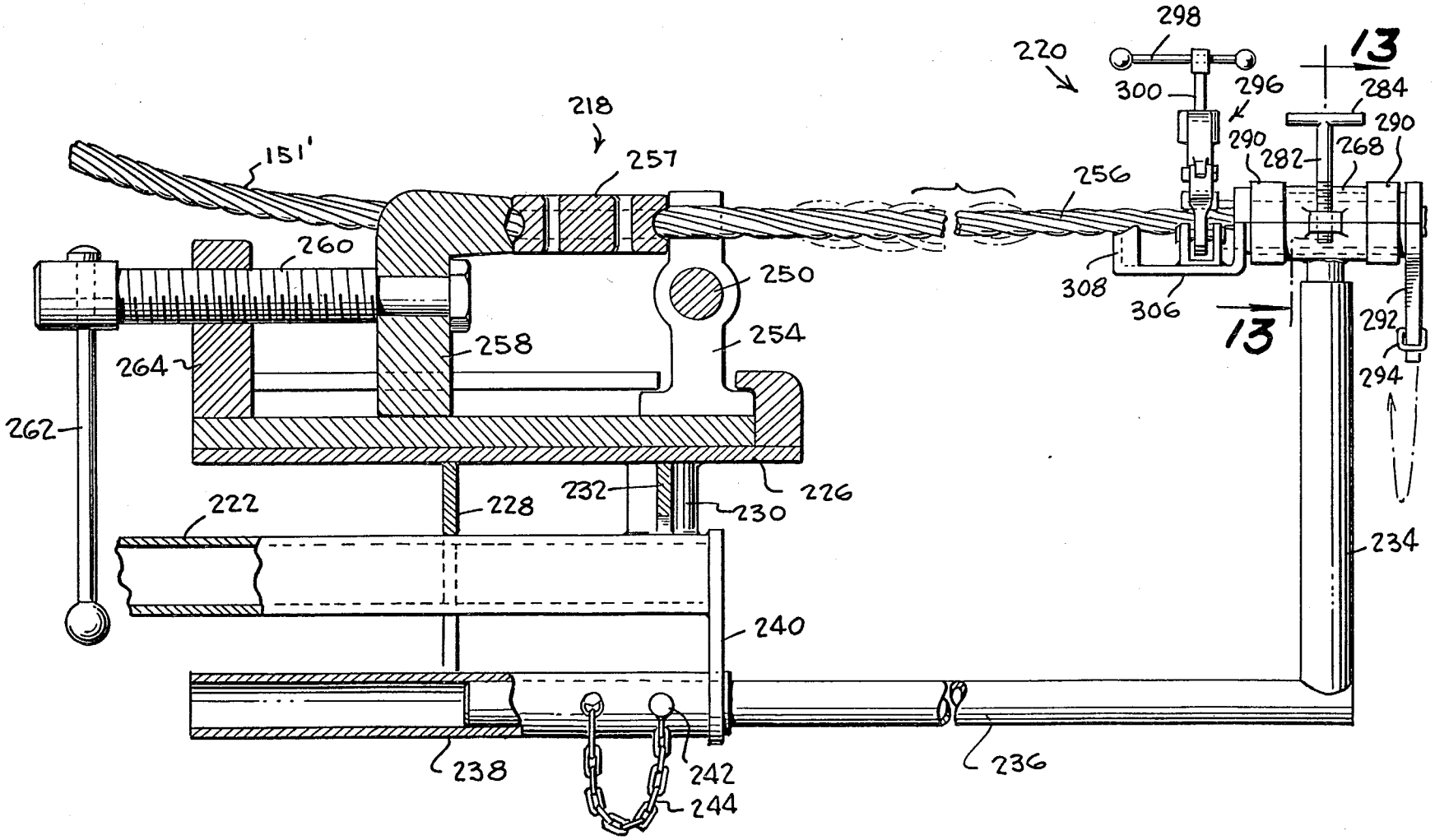
FIG. 12 is a fragmentary cross-sectional view of the rigger's vise and twister device taken along line 12—12 in FIG. 11.

The twister mechanism 220 is mounted on a support tube 234 welded at right angles to a telescoping tube 236 as shown in FIG. 10. The telescoping tube 236 is slidable within a larger diameter tube 238 welded to the support plate 228 and an end plate 240 fixed to the end of square shaft 222 as best shown in FIGS. 10 and 12. A locking pin 242 attached to the guide tube 238 by a short piece of chain 244 is insertable through registrable holes in the support tube 238 and the support shaft 236, as indicated in FIG. 10, to lock the twister mechanism in the desired upright position.

As can be noted from FIG. 10, a second pair of radial holes 246 passes through the support tube 236 adjacent the upright tube 234 at right angles to the extended position holes in which the pin is inserted as shown in FIG. 10. Having the holes 246 at right angles permits rotation of the twister mechanism downward to the retracted position indicated in FIG. 3 for transportation over the highway.

The rigger's vise 218 is of conventional construction and includes a pair of movable jaws 248 which are movable in opposite directions by threaded screw 250 as handle 252 is rotated by the user to bring the jaws 248 closer together or further apart. The threaded shaft 250 is rotatably supported in bearings 254 and, as can be seen, the shaft is oppositely-threaded on either side of the center line of the vise which causes the movable jaws to move in opposite directions.

When the vessel cable 151 and a new cable 256 are clamped in the rigger's vise as indicated in FIGS. 10, 11 and 12 the cables are clamped between the movable jaws 248 with a deadeye 257 forced between the cables as shown in FIGS. 10 and 12 by a third movable jaw 258 movable by a threaded shaft 260 having the movable jaw 258 rotatably retained at one end thereof. Rotation of a handle 262 by the operator causes the threaded shaft 260 to advance through a threaded upright member 264 as indicated in FIG. 12.

The twister mechanism 220 is utilized to relieve the tension in the twist of the cable and includes a fixed split sleeve 266 in the form of a longitudinally split cylindrical tube having an upper half portion 268 pivotally attached by a longitudinal hinge 270 to a lower half portion 272, as shown in FIGS. 13 and 14. The lower portion 272 is welded to a plug 274 insertable into, and welded in, the upper end of the support tube 234 as indicated in FIG. 15. Opposite the hinge 270, on the upper portion 268 of the fixed split sleeve 266 and the lower portion 272, are outwardly projecting tabs 274 and 276 having threaded bores 278 and 280 therethrough, such that the threaded bores are in alignment to receive a threaded end 281 of a T-bar 282 which permits locking of the split sleeve 266 in the closed position as shown in FIG. 13.

The upper portion 284 of the T-bar 282 permits the user to grasp the T-bar and thread the thread end 281 of the T-bar into the threaded bores 278 and 280 to clamp the upper and lower halves 268 and 272 of the split sleeve 266 together as shown in FIG. 13. Unthreading the T-bar 282 permits opening of the fixed split sleeve 266 as shown in FIG. 14. Extending longitudinally through the fixed split sleeve 266 is a rotatable split sleeve 284 being formed of a longitudinally split cylindrical tube having a slightly smaller outside diameter than the inside diameter of the fixed split sleeve 266 and being longer than the split sleeve 266 to extend beyond both ends of the split sleeve 266. The rotatable split sleeve 284 includes an upper half portion 286 and a lower half portion 288 which are retained within the fixed split sleeve 266 by semi-circular guide rails 290 welded to the outer surface of the upper and lower portions 286 and 288, as shown in FIGS. 10 and 12–15. Longitudinal hinges 289, as indicated in FIGS. 13 and 14, connect the upper and lower guide rails 290 at opposite ends of the rotatable split sleeve 284. Guide rails 290 include lips 291, as shown in FIG. 15, which extends over the upper portion 268 and lower portion 272 of the fixed split sleeve 266 to prevent the rotatable sleeve from being removed from the interior of the fixed split sleeve 266 when the twister mechanism 220 is opened as shown in FIG. 14. Handles 292 are welded to the upper and lower guide rails 290 at one end of the rotatable split sleeve to permit the operator to rotate the handle and the rotatable split sleeve 284 in either direction.

A retainer clip 294, as shown in FIG. 10, may be provided to keep the handles 292 in the closed position. When the line of separation between the upper portions and the lower portions of the fixed and rotatable sleeves are in alignment, as shown in FIG. 14, and as occurs when the hinge 270 is rotated to be in alignment with the hinge 289, the twister mechanism may be opened as indicated in FIG. 14 to receive or release the cable 256 as shown in FIG. 13.

Fixed to the lower portion 288 of the rotatable sleeve 284 is a conventional plumber's vise 296 for clamping the cable 256 relative to the rotatable sleeve 284. The plumber's vise 296 includes a handle 298 for rotating a threaded shaft 300 to cause a movable jaw 302 to move toward a fixed jaw 304. The plumber's vise 296 is fixed to the rotatable sleeve 284 by a mounting bracket 306 welded to the lower portion 288 at the end opposite the handles 292 and closest to the rigger's vise 218 as shown in FIGS. 10 and 12. A support lip 308 extends outwardly from the mounting bracket 306 of the plumber's vise 296 to provide support for the cable 256 as best shown in FIG. 12.

Operation of the marine rigging apparatus according to the present invention, is easily and quickly accomplished. The truck 20 is pulled onto the dock and the old cable 151 from the fishing vessel is attached to the reel drums 86. The latching portion 134 of the dog-clutch 114 is engaged in slot 136 of the latching hub 138 on the drive shaft 94. Valve 36 at the left rear of the truck deck is actuated by the operator to supply pressurized hydraulic fluid to hydraulic drive motor 100 which causes drive shaft 94 and drum 68 to rotate. The old cable from the fishing vessel may then be winched onto the drum 86. Both cables may be simultaneously removed from the fishing vessel onto the drums 86. The total time necessary to take the cable off the vessel is 15 to 30 minutes and requiring only two men. Thus, it will be seen that the worn free end of the old cable 151, which had been the outer end of the cable on the vessel winch, is attached to drums 86 or 88 so that upon completion of the reeling of the old cable onto the drums, the less-worn free end 151′ (FIG. 10) of the old cable will be the free end of the cable. Thus, end 151′, which is the best end of the old cable, is consequently available for splicing to the new cable 256 in a manner to be discussed hereinafter.

Traffic, dock space and weather are no longer a significant factor in the operation and it is possible for a marine rigging truck according to the present invention to remove the cable from several vessels in a single trip. After removal of the cable, the truck may then be driven to a convenient location having two spools of new cable available for splicing and marked with the fathom markers.

The splicing mechanism 30 is pulled rearwardly from the truck causing square shaft 222 to slide in tube 224 to the position shown in FIG. 4. The twister mechanism 220 is extended outwardly by pulling the retaining pin 242 out of hole 246 in the support tube 236 and rotating the twister mechanism upwardly to the position shown in FIG. 10 with the retaining pin 242 then reinserted to lock the twister mechanism in spaced relation to the rigger's vise 218.

Insertion of the new cable 256 into the twister mechanism 220 is permitted, as shown in FIG. 14 by separating the handles 292 after the T-bar 282 has been unthreaded from the lower tab 276 and by opening the plumber's vise 296. Alternatively, the free end of the new cable 256 may be pushed through the rotatable sleeve 284 and through the plumber's vise 296 to the position indicated in FIG. 10 where it extends between the movable jaws 248 on the rigger's vise 218. The old cable 151 is pulled from the drum 86 and extended to the position shown in FIG. 10 where it passes between the movable jaws 248 of the rigger's vise 218. A deadeye 257 is inserted between the new cable 256 and the old cable 151 and the movable jaws are moved together by rotating handle 252 with the deadeye being positioned by rotation of handle 262 to lock the new and old cables in the rigger's vise. The handle 298 on the plumber's vise 296 is rotated to lock the cable 256 between the movable jaw 302 and the fixed jaw 304.

The handle 292 is then rotated in the direction indicated in FIGS. 10 and 12 to relieve the tension in the twist of the cable if regular right-hand lay wire rope is being utilized. This twisting motion opens up the strands as indicated in FIG. 10 to greatly increase the efficiency of the conventional splicing operation. A conventional splice as indicated in FIG. 10 is formed between the old cable 151 and the new cable 256 to produce the splice shown in FIG. 16. If a second splice as indicated in FIG. 17 is desired, the direction of the cables is reversed and the splicing operation again performed.

After the new cable has been spliced to the old cable, the cable is wound into the drum 86 and the truck returns to the dock where the new cable end is attached to the vessel's drums and the fishing vessel's winches wind the cables from the drums 86 onto the vessel's drums with the operator activating brake levers 154 as necessary to prevent the cables from becoming tangled as they are wound onto the vessel's drums. The entire operation is accomplished in approximately 1 hour.

Spools 196 of cable may be moved to the desired location by extending the piston 161 of the hydraulic cylinder 62 as necessary to position the hook 72 in the desired position over a spool resting on the ground. Cargo winch 22 is then activated by hydraulic valve 36 at the left-rear corner of the truck to retract the cable 38 onto the drum 34 thereby causing the block 56 to be raised upwardly toward the boom and lift the drum 196 off the ground. The piston 161 of the hydraulic cylinder 62 is then retracted to cause the trolley 54 to move toward the front of the truck to the desired position at which the drum 196 is lowered onto the drive cylinder 198 and the support roller 210. The cable on the spool 196 is unreeled onto the rigging drums 86 or cable is taken off the rigging drums 86 and reeled onto the spool 196 through activation of the coiling hydraulic motor 206 by actuation of valve 208.

As can be seen from the preceding discussion, the present invention provides a method and apparatus for quickly and efficiently replacing the wire cable on a fishing vessel which is not dependent upon having good weather or having large areas of dock space.

From the foregoing detailed description, it will be evident that there are a number of changes, adaptations, and modifications of the present invention which come within the province of those skilled in the art. However, it is intended that all such variations not departing from the spirit of the invention, be considered as within the scope thereof as limited solely by the appended claims.

I claim:

1. A marine rigging apparatus for splicing new wire cable of the type having twisted wire strands to a portion of work wire cable taken from a rotatable drum on a fishing vessel docked or moored adjacent a dock, said apparatus comprising a motor vehicle, a base mounted on said motor vehicle, bearing means fixedly mounted on said base, shaft means mounted on said bearing means for rotation about the axis of said shaft means, said axis of said shaft means being fixedly positioned with respect to said base, at least one drum rotatably supported by said shaft means, power means operatively connected to said drum for rotating said drum about the axis of the shaft means to wind said worn cable onto said drum, clamping means mounted on said base for restraining portions of cables to be spliced with the cables being restrained against rotation about the axes of the cables, and twister means mounted on said base for rotating a first of said cables in a direction opposed to the natural twist of said first cable to relieve the tension in the strands of said first cable at a desired location on the cable to permit an efficient and quick splicing of a second of said cables to said first cable.

2. The apparatus of claim 1 wherein said twister means includes a twister bearing mounted on said base, means rotatably supported by said bearing for gripping said first cable and means for rotating said gripping means relative to said clamping means to untwist a portion of said first cable held between the clamping means and the gripping means.

3. The apparatus of claim 2 wherein said clamping means includes a rigger's vise.

4. The marine rigging apparatus of claim 1 additionally including a front-to-rear extending cargo boom mounted in an elevated position above said base, trolley means mounted for movement along the length of said cargo boom, a pulley on said trolley means and a power actuated cable extending over said pulley.

5. The marine rigging apparatus of claim 4 additionally including power means for selectively positioning said trolley at desired locations along said front-to-rear extending cargo boom.

6. The marine rigging apparatus of claim 4 additionally including hydraulic power means for selectively positioning said trolley at desired locations along said cargo boom.

7. The marine rigging apparatus of claim 4 wherein said power means comprises a hydraulic cylinder.

8. The marine rigging apparatus of claim 1 additionally including a front-to-rear extending cargo boom mounted in an elevated position above said base, trolley means mounted for movement along the length of said cargo boom, a pulley on said trolley means, a power actuated cable extending over said pulley and coiling means mounted on a rearmost portion of said deck.

9. A marine rigging apparatus for splicing new wire cable of the type having twisted wire strands to a portion of worn wire cable taken from a rotatable drum on a fishing vessel docked or moored adjacent a dock, said apparatus comprising a base, a bearing mounted on said base, at least one drum rotatably supported by said bearing, power means operatively connected to said drum for rotating said drum to wind said worn cable onto said drum, clamping means mounted on said base for restraining portions of cables to be spliced with the cables being restrained against rotation about the axes of the cables, and twister means mounted on said base for rotating a first of said cables in a direction opposed to the natural twist of said first cable to relieve the tension in the strands of said first cable at a desired location on the cable to permit an efficient and quick splicing of a second of said cables to said first cable, said twister means including a twister bearing mounted on said base, means rotatably supported by said bearing for gripping said first cable, and means for rotating said gripping means relative to said clamping means to untwist a portion of said first cable held between the clamping means and the gripping means, said twister bearing including a fixed split sleeve having one portion thereof attached to said base, and said cable gripping means including a rotatable split sleeve journaled within said fixed split sleeve, means for opening and closing said rotatable split sleeve, and a vise mounted on said rotatable split sleeve thereby permitting the insertion of a cable through the rotatable sleeve and clamping of the cable by the vise and further including a front-to-rear extending cargo boom mounted in an elevated position above said base, trolley means mounted for movement along the length of said cargo boom, a pulley on said trolley means, a power actuated lift cable extending over said pulley and hydraulic power means for selectively positioning said trolley at desired locations along said front-to-rear extending cargo boom.

10. A method of removing the worn free end of an old wire cable on a rotatable drum of a fishing vessel moored against a dock and splicing new wire cable to the opposite less-worn end of the old cable, said method comprising the steps of positioning a power driven rotatable reel drum adjacent the vessel, attaching the worn free end of said old cable to said reel drum, rotating said reel drum to effect removal of all of the old cable from the fishing vessel, clamping a portion of the opposite less-worn end of said old cable and the free end of the new cable inwardly of their ends in vise means to restrain the cables, gripping the new cable near the clamped portion of the new cable and rotating the new cable about the axis of the cable in a direction opposed to the natural twist of the cable to provide an untwisted portion of the strands of the new cable, splicing the less worn end of the old cable into the untwisted portion of new cable, terminating the clamping and gripping, and unreeling the combined cable onto the drum of the vessel.

11. The method of claim 10 wherein said power driven rotatable reel is transported from the dock to a convenient location prior to the splicing of the old cable to the new cable.

12. The method of claim 10 wherein said new cable and said old cable are clamped in a single vise means prior to the untwisting of the new cable.

13. The method of claim 12 wherein said power driven rotatable reel is transported from the dock to a convenient location prior to the splicing of the old cable to the new cable.

* * * * *